US005810171A

United States Patent [19]

Lee

[11] Patent Number: 5,810,171

[45] Date of Patent: Sep. 22, 1998

[54] BAG BUFFER

[75] Inventor: Youn-jae Lee, Kangnam-ku, Rep. of Korea

[73] Assignee: Jinwoong Ltd., Kyunggi-do, Rep. of Korea

[21] Appl. No.: 781,074

[22] Filed: Jan. 9, 1997

[30] Foreign Application Priority Data

Nov. 6, 1996 [KR] Rep. of Korea ..... 1996 52290

[51] Int. Cl.[6] ..... B65D 81/107

[52] U.S. Cl. ..... 206/523; 206/320; 383/109

[58] Field of Search ..... 206/521, 523, 206/586, 589–594; 267/81, 140.3, 140.4; 383/109; 428/138

[56] References Cited

U.S. PATENT DOCUMENTS

| | | | |
|---|---|---|---|
| 2,538,880 | 1/1951 | Robell | 267/81 |
| 3,166,768 | 1/1965 | Cunningham | 267/81 |
| 3,270,998 | 9/1966 | Keetch | 267/140.3 |
| 3,283,988 | 11/1966 | Hardigg | 206/586 |
| 3,948,436 | 4/1976 | Bambara | 206/523 |
| 4,981,215 | 1/1991 | Ilic | 206/521 |
| 5,222,264 | 6/1993 | Morry | 267/81 |
| 5,226,557 | 7/1993 | Nelson | 206/586 |

*Primary Examiner*—Jimmy G. Foster

*Attorney, Agent, or Firm*—Christie, Parker & Hale, LLP

[57] ABSTRACT

A bag buffer is applied to a bag, the bag buffer consisting of two plates, springs, and a sponge, the springs and the sponge being disposed between the two plates, such that the bag buffer can effectively buffer outside shocks to protect articles contained in the bag as well as to easily carry and use the articles.

5 Claims, 3 Drawing Sheets

BAG BUFFER

BACKGROUND

The present invention relates to a bag buffer, and more particularly to a bag buffer so as to keep shock-sensitive articles (i.e., notebook computers) in safety, and to carry and use easily.

Conventionally, to protect articles contained in bags from outside shocks during carrying or keeping, shock-absorbing material like sponge is thinly installed on the inner surface of a bag, or articles are wrapped in shock-absorbing wrapper.

However, thin sponge installed in a bag cannot safely protect articles from severe outside shocks. Furthermore, wrapping articles with shock-absorbing wrapper is difficult to apply where the articles are frequently taken out for use like notebook computers.

SUMMARY

It is therefore an object of the present invention to overcome the above-described prior art drawbacks and to provide a bag buffer enabling to keep shock-sensitive articles contained in the bag safely in a new manner as well as to carry and use easily, differing from methods of the prior art, and the assembly thereof.

To overcome the conventional problems described above, the present invention provides a bag buffer, comprising two plates, a first buffer member, and a second buffer member, both installed between these two plates.

The first and second buffer members have different elastic constants from each other so that outside shocks can effectively be absorbed by the buffers through multiple means, thereby preventing articles contained in a bag from being broken.

BRIEF DESCRIPTION OF DRAWINGS

Further objects and other advantages of the present invention will become apparent from the following description in conjunction with the attached drawings, in which.

DESCRIPTION

Figure 1:
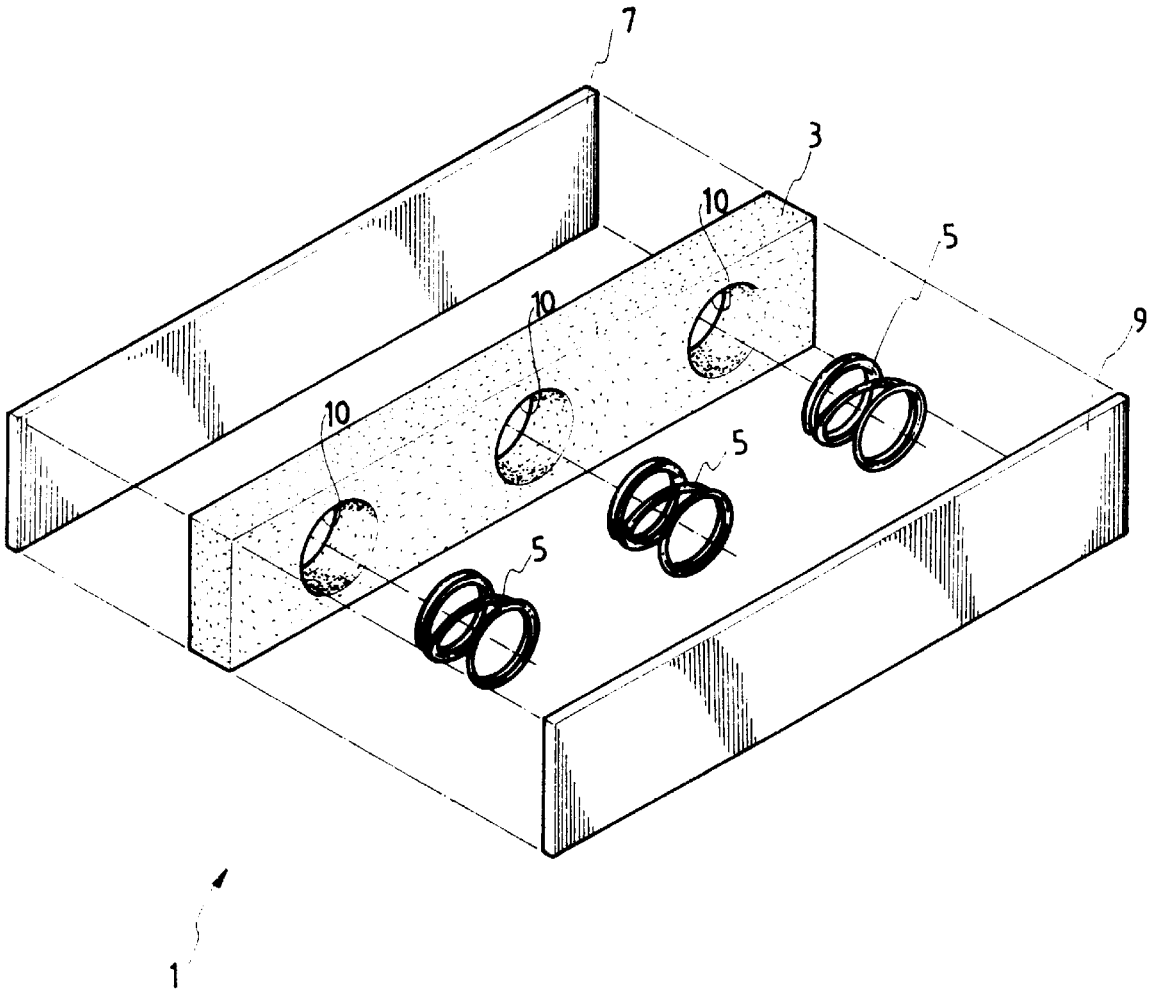
FIG. 1 is an exploded perspective view of a bag buffer in accordance with a preferred embodiment of the present invention.

Referring to FIG. 1, there is shown an exploded perspective view of a bag buffer in accordance with a preferred embodiment of the present invention, in which reference numeral 1 indicates a bag buffer.

Figure 3:
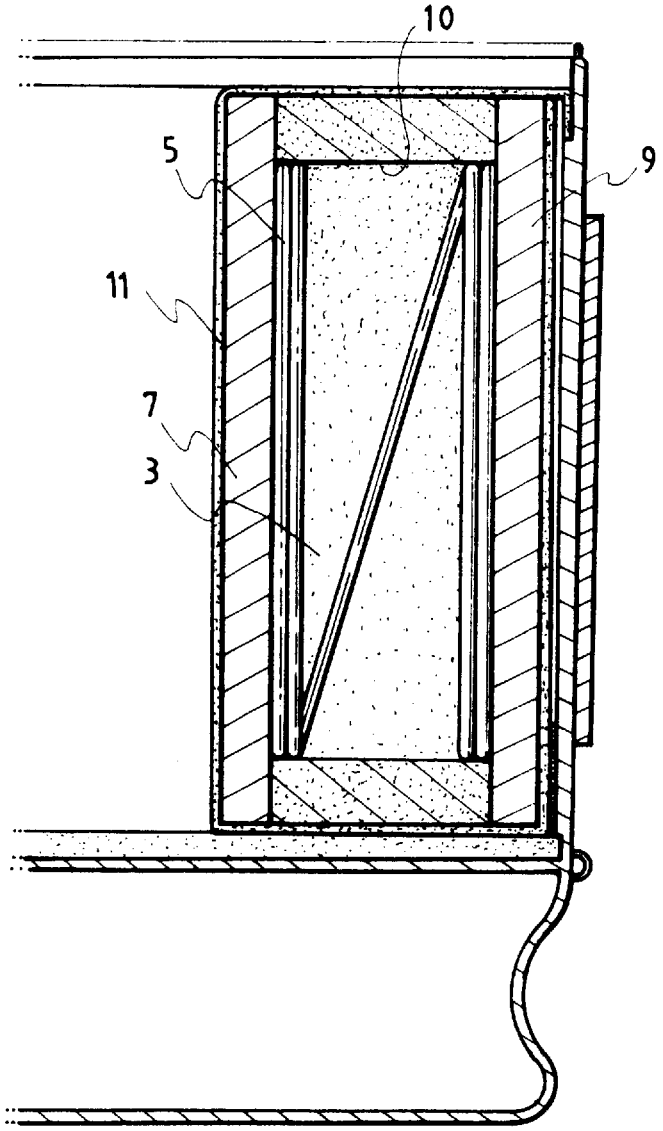
FIG. 3 is a sectional view of a bag buffer in accordance with a preferred embodiment of the present invention.

As shown in FIGS. 1 and 3, a bag buffer 1 comprises springs 5 as a first buffer member and a sponge 3 as a second buffer member, all of which are installed between two plates 7 and 9 and combined with each other at the same time. The first buffer member 5 has elastic constants higher than that of the second buffer member 3.

In this embodiment, there is provided three circular holes 10 in the sponge 3 such that springs 5 can snugly be placed in the circular holes 10 respectively. The sponge 3 incorporated with the springs 5 is disposed between two plates 7 and 9.

Figure 2:
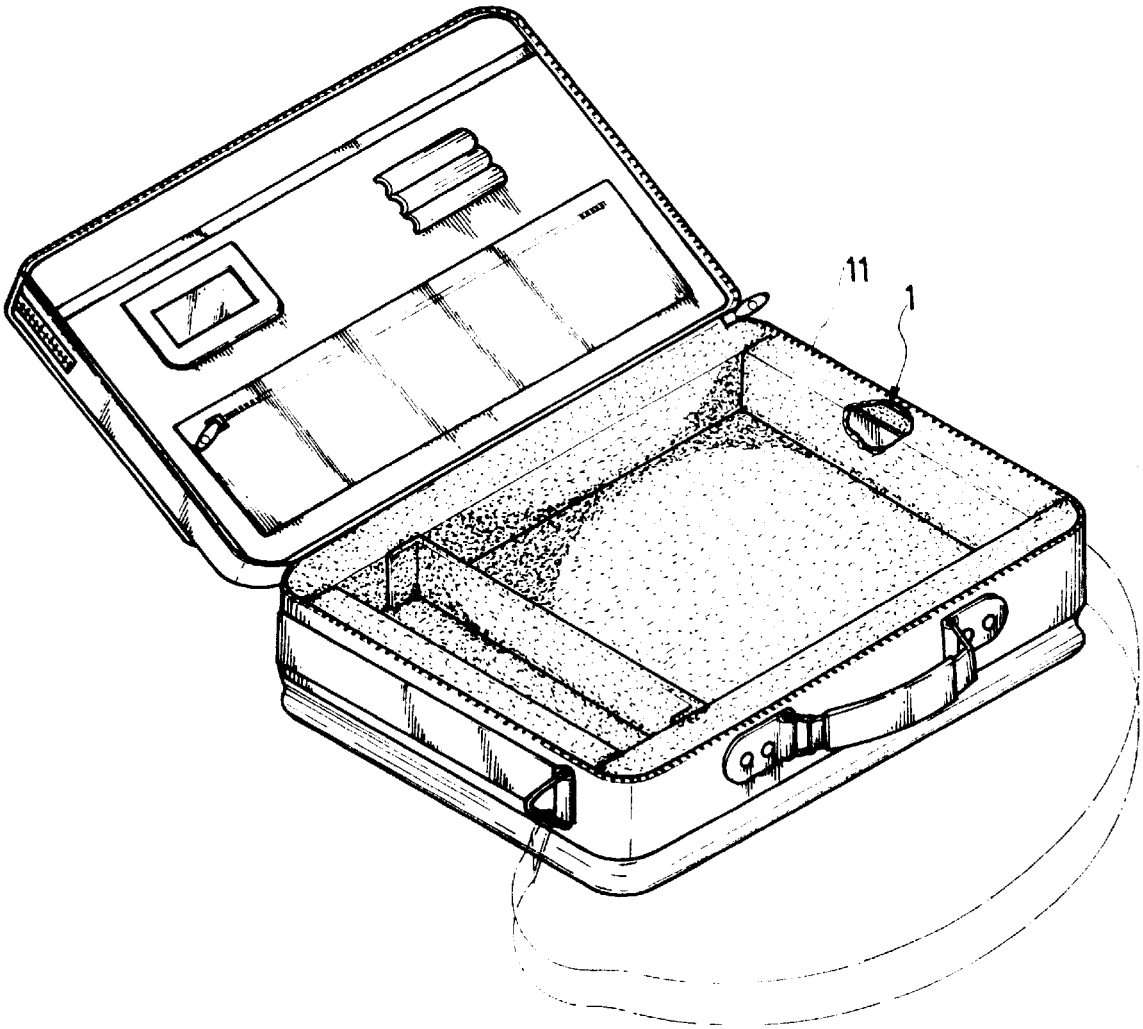
FIG. 2 is a perspective view of a bag in which a bag buffer in accordance with a preferred embodiment of the present invention is applied.

FIG. 2 is a perspective view of a bag in which a bag buffer 1 for a bag in accordance with a preferred embodiment of the present invention is applied, while FIG. 3 is a sectional view of a bag buffer 1 for a bag according to a preferred embodiment of the present invention, in which a bag buffer 1 is installed in the inner surface of a bottom side, a top side, a left side, and a right side, respectively, thus forming an inner peripheral edge, and being covered with covering material 11.

As described above, a bag buffer 1 for a bag is installed to form an inner peripheral edge, since an edge of a flat object generally impacts first, before a wide surface of the object when a flat object is dropped. If necessary, a bag buffer can be installed in all planes of a bag.

Therefore, if outside shocks are transmitted to one side of a bag buffer 1 (i.e., one of two plates 7 and 9), the shocks are buffered by springs 5 of the first buffer member having relatively higher elastic constants and also gradually reduced by a sponge 3 of the second buffer member having relatively lower elastic constants simultaneously, thereby effectively buffering outside shocks transmitted to articles contained in a bag.

Although a preferred embodiment of the present invention has been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A shock absorbing bag having front, rear, left, right, top and bottom sides, comprising:

at least one buffer mounted on one of said bottom, left and right sides, said at least one buffer comprising:

two planar elements disposed parallel to the corresponding side;

a first elastic member disposed between said two planar elements, said first elastic member having at least one hole extending through the first elastic member, a central axis of the at least one hole being perpendicular to each of said planar elements; and at least one second elastic member snugly inserted into the at least one hole, said at least one second elastic member having an elastic constant higher than that of said first elastic member.

2. The shock absorbing bag according to claim 1, wherein said first elastic member is made of a material selected from the group consisting of sponge.

3. The shock absorbing bag according to claim 1, wherein said at least one second elastic member is a metal spring.

4. The shock absorbing bag according to claim 1, wherein said at least one second elastic member is a coil spring.

5. The shock absorbing bag according to claim 1, wherein said at least one hole comprises a cylindrical hole.

* * * * *